United States Patent [19]

Zeiringer

[11] Patent Number: 4,786,319

[45] Date of Patent: Nov. 22, 1988

[54] PROCES FOR THE PRODUCTION OF RARE EARTH METALS AND ALLOYS

[75] Inventor: Hans Zeiringer, Krappfeld, Austria

[73] Assignee: Treibacher Chemische Werke AG, Treibach, Austria

[21] Appl. No.: 87,088

[22] Filed: Aug. 19, 1987

[30] Foreign Application Priority Data

Aug. 19, 1986 [AT] Austria ..... 2226/86

[51] Int. Cl.[4] ..... C22B 4/00; C21C 5/52

[52] U.S. Cl. ..... 75/10.62; 75/84

[58] Field of Search ..... 75/84, 10.62

[56] References Cited

U.S. PATENT DOCUMENTS 4,177,059 12/1979 Day ..... 75/84

4,197,422 4/1980 Fuchs et al. ..... 13/32

FOREIGN PATENT DOCUMENTS 1040468 8/1966 United Kingdom .

OTHER PUBLICATIONS

Ullmann Encyclopedia, vol. 21, pp. 260/1.

*Primary Examiner*—Peter D. Rosenberg

*Attorney, Agent, or Firm*—Kurt Kelman

[57] ABSTRACT

The invention relates to a process for the production of rare earth metals and alloys thereof. The process exploits the known advantages of metallothermal reduction techniques while decisively enhancing their reduction process. Rare earth halides and/or rare earth oxides are reduced in an electric arc furnace by means of one or several alkaline earth metals, preferably, calcium. Additives such as iron metals or other alloying elements, alkali- and/or alkaline earth metal salt, may be added to the electric arc furnace in a two-phase furnace operation. The reduction takes place in an atmosphere inert to rare earth metals, rare earth compounds, and alkaine earth metals. Agitation is produced in the metal in the furnace by eletromagnetic forces caused by a suitably selected current-to-voltage ratio for the electric arc, in order to achieve reduction in the shortest possible time and as completely as possible.

15 Claims, 1 Drawing Sheet

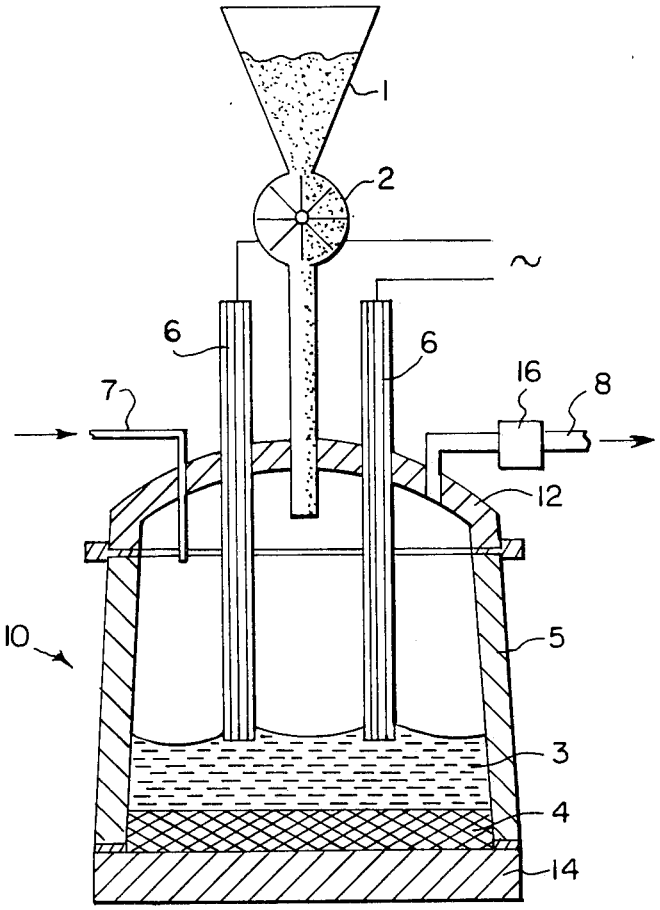
1
2
~
6
6
16
8
7
12
10
5
3
4
14

PROCES FOR THE PRODUCTION OF RARE EARTH METALS AND ALLOYS

BACKGROUND OF THE INVENTION

1. Field of the Invention

The invention relates to a process for the production of rare earth metals and rare earths-containing alloys. This process is characterized in that rare earth halides and/or rare earth oxides are reduced individually, or in a mixture, in an electric arc furnace. The process utilizes one or several alkaline earth metals and, optionally, alloying additives selected from the group of iron metals and other alloying elements. Also, optionally, additions of alkali salts and/or alkaline earth metal salts can be utilized. The process takes place in an atmosphere which is largely inert to rare earth metals, rare earth compounds and alkaline earth metals. In addition, a strong agitation effect is produced by electromagnetic forces in the melt in the furnace so as to achieve reduction as quickly and as completely as possible.

2. Description of the Prior Art

Rare earth metals and rare earth alloys are used in many industrial fields. The mixed cerium metal, for example, is widely used as a metallurgical additive for steels, cast iron and magnesium, etc. Such a mixed cerium metal is a mixture made up of metals of the so-called "light rare earths" or cerite earths and which has the approximate distribution of the elements La, Ce, Pr, Nd, Sm, and Eu as found in natural deposits (bastnasites and monazites). In steel, mixed cerium metal bonds with the residual sulfur to produce a very low sulfur content steel. In cast iron, it promotes the formation of spherical graphite and reduces the porosity. In magnesium, mixed cerium metal increases the strength and resistance to heat.

The oldest and perhaps most widely known application of mixed cerium metal is its use in the production of ignition alloys. Such alloys are based on an alloy of mixed cerium metal with iron as well as various other metals that enhance the pyrophoric property, producibility and storability. Alloy types such as $LaNi_5$, in which La may be replaced in part by Ce, Pr and Nd, and Ni by Co, Cr, Cu, Fe, are capable of storing hydrogen with formation of rare earth hydrides. In the sixties, Strnat found the $YCo_5$- and $Y_2Co_{17}$-compounds have a very high uniaxial magnetic crystal anisotropy and thus possess hard magnetic properties. These findings led to the development of a number of rare earth alloys with 3d-transition elements of type SEA5 or SE2A17. The cerite earths were used in these rare earth alloys as rare earth metals, in particular Sm, and Co as 3d-transition metal, in part substituted with Fe, Mn, Cr, and also Cu. Excellent hard magnetic properties, i.e., high energy products, remanence and high coercive field strengths are the common characteristics of this type of rare earth alloy. Permanent magnets have been industrially manufactured on the basis of $SmCo_5$ and $Sm_2Co_{17}$ since the seventies.

In the years thereafter, the discovery of Strnat has led to intensive worldwide research activities resulting in enhanced hard magnetic materials based on rare earths. The hard magnetic alloys based on neodymium, iron and boron, developed in the laboratories of General Motors and Sumitomo Special Metals, at about the same time, represent at least for now, the limit of these developments. The European patent applications of General motors (European applications Nos. 0 108 474 A2 and 0 125 752 A2) and Sumitomo Special Materials (European applications Nos. 0 101 552 A2; 0 106 948 A2; 0 125 347 A2; 0 126 179 A1; and 0 126 802 A1) describe such alloys, their manufacture and processing to hard magnetic materials. Viewing the applications filed by these two laboratories in combination, it is obvious that they overlap one another with respect to the composition of the alloy. A significant difference, however, exists in the preparation of the alloy for the production of hard magnetic materials. According to the Sumitomo process, the alloys structured from their individual components are preferably melted in an induction furnace, cast in blocks, subsequently crushed and ground to particles in the μm-range. For achieving anisotropic magnets, the resulting powder is compressed in a magnetic field, to form blanks, and sintered. The sintered blanks are then subjected to a heat treatment, whereupon final magnetizing is carried out.

According to the General Motors process, the alloy is formed in the normal manner from its individual components and then is melted and rapidly cooled by casting on a rotating copper roll (melt spinning). In this cooling step, the alloy solidifies to an extremely microcrystalline or amorphous structure. The resulting platlet-shaped powder is subsequently re-ground and then formed into magnetic materials by means of plastic or metal bonding agents. If one were to disregard the variations in the special manufacturing steps between these two processes, there are no special procedures followed for producing the actual alloys or special starting materials. Rather, conventional methods are employed. Known procedures have been introduced into this technological field, whereby preferably pure neodymium or neodymium prealloyed with iron, iron and boron or ferroboron are used as starting materials. The literature contains various methods (see Ullmann, Volumes 9 and 21) for the production of neodymium and most other rare earth metals and their iron-containing prealloys. The most widely known and used procedures are fusion electrolysis and metallothermal reduction. In the fusion electrolysis process, the halides of the rare earths are preferably used as raw materials. They are often used with alkali halides or alkaline earth halides. The rare earth metals separated on the cathode may be pure or prealloyed with metals from the iron group in the periodic system or another alloying element. In an electrolysis process developed by the Bureau of Mines, rare earth oxides are used as the raw material. The electrolyte is a mixture composed of various rare earth alkali fluorides or alkaline earth fluorides. In the metallothermal reduction process, the halides of the rare earths are usually used as the raw material. In some cases, alkali halides and alkaline earth halides are added as slag-forming agents or fluxing agents. While the alkali metals and/or alkaline earth metals may serve as a reducing agent, calcium is the preferred reducing agent. As a rule, the metallothermal reduction is carried out in a closed vessel in an atmosphere inert to both the reducing agent and the rare earth metal formed in the course of this step.

The electrolytic manufacture of different rare earth metals with the use of their halides and, in particular, chlorides, requires that the chlorides be free from bonded water and oxygen compounds (e.g., oxychlorides) that may be present. Furthermore, as a rule, only those rare earth metals whose melting point does not significantly exceed 1000° C. can be produced in an economically justifiable way. Adding iron to the alloy, for example, will reduce the melting point, however, such alloying makes the electrolysis conditions more difficult and, as a rule, precludes the use of refractory metals as lining materials. European patent application No. 0 177 233 (Sumitomo) describes the electrolytic manufacture of iron-containing Nd-alloys. However, this application does not seem to teach how to produce specific high-iron boron-containing alloys with a composition conforming to one of the finished magnet alloys (NdFeB). Furthermore, the fact that only a small cathode cross section (cathode load) is possible poses problems in terms of electrolysis technology.

Furthermore, the metallothermal reduction processes using the rare earth halides or rare earth oxides as raw materials and calcium, for example, as the reducing agent produce a whole series of process engineering problems. The reaction, which takes place at a relatively slow rate and incompletely, requires that additional energy be supplied from outside the reactor. The ambient atmosphere has to be inert to the reducing agent and the reaction product. This means that the material of the crucible or lining of the reaction vessels has to meet stringent requirements. For example, no lining consisting of tantalum, molybdenum or tungsten is suitable for the production of iron-containing alloys. Linings consisting of MgO, $Al_2O_3$ and/or CaO are required, but these put up little resistance to molten chlorides or fluorides and have an insulating effect on the heat supply. Furthermore, the process conditions usually permit only batch operation which results in high costs. The direct manufacture of a finished Se-Co magnet alloy requires a high expenditure for the necessary equipment (AT-PS No. 336,906 - Th. Goldschmidt), and only produces impure alloy powders. These powders have to be purified via chemical purification procedures to remove slag or reaction products. The advantage of the metallothermal manufacture of rare earth metals and alloys over fusion electrolysis lies in the relatively higher reaction rate. In addition, wider temperature ranges can be utilized. Also, the water and oxygen content of the raw materials used is less critical.

SUMMARY OF THE INVENTION

Accordingly, it is an object of the present invention is to exploit the known advantages of metallothermal reduction processes while also enhancing the reduction technique.

It is also an object of the invention is to produce both pure rare earth metals and their various alloys and, in particular, the Nd-Fe-B-alloy by one process.

These objects are accomplished by the process of the present invention. In this process, the rare earth halides and/or rare earth oxides are reduced individually or in a mixture by means of one or several alkaline earth metals. Preferably, calcium metal is used as a reducing agent with the reduction taking place in an electric arc furnace in a two-phase furnace operation. It may be optimal to add alloys, some of which may be selected from the group of ferrous metals. Also, alkali and/or alkaline earth metal salts may be added. The reduction takes place in an atmosphere inert to rare earth metals, rare earth compounds and alkaline earth metals. A strong agitation is produced in the metal contained in hte furnace by electromagnetic forces to achieve the reduction in the shortest possible time and as completely as possible. The agitation effect is generated by a suitably selected current-to-voltage ratio.

Other objects and features of the present invention will become apparent from the following detailed description considered in connection with the accompanying drawing, which discloses one embodiment of the invention. It is to be understood that the drawing is to be used for the purpose of illustration only, and not as a definition of the limits of the invention.

BRIEF DESCRIPTION OF THE DRAWINGS

The drawing is a schematic cross-sectional view of the furnace developed to carry out the process of the present invention.

DETAILED DESCRIPTION OF THE PREFERRED EMBODIMENT

Referring to FIG. 1, there is shown the furnace, generally denoted as 10, developed for carrying out the reduction process of the present invention. The mixture composed of the predetermined raw materials including the reducing agent and, optionally, additional alloys and materials are introduced from supply vessel 1 via a paddle-wheel gate 2 into the interior of the furnace 10 and into melt 3 contained within the furnace. The furnace body walls 5 consist of a water-cooled iron jacket and are enclosed by a cover or roof construction 12 placed over the jacket walls 5. Normally, the roof 12 is water-cooled as well. The furnace 10 has a bottom 14 which is lined with MgO bricks. Normally, a mixture consisting of alkali halides and/or alkaline earth halides with a layer thickness of 2 to 3 cm is premelted on the bottom of the furnace 10. In order to produce a furnace atmosphere that is inert to the reaction components and the reaction product, a stream of argon or nitrogen is admitted into the furnace interior via conduit 7. The exhaust gases are able to escape from the furnace interior by way of the exhaust gas conduit 8, which includes a check valve 16 to prevent a return flow.

Electrical energy is fed into the melt 3 via electrodes 6. The current intensity on the electrodes 6, which are immersed in the melt, is preselected so that the electromagnetic forces occurring in the process produce an agitating effect. This agitating effect is of such magnitude that the newly introduced mixture is immediately pulled into and intimately blended with the melt 8 already present. The result is a very rapid and complete reduction with a very low burn-off loss. Such burn-off losses may be caused by a furnace atmosphere which contains oxygen. The metal or alloy 4 formed is deposited on the bottom of the furnace on a thin, solid layer of slag that had formed from the premelt salts. This alloy is tapped from the furnace from time to time via a tap spout (not shown).

The furnace as described above may have walls manufactured from normal iron sheet. Problems in using iron sheet are avoided by heavily cooling the walls with water and by the 5 to 10 mm thick layer of the salt slag solidified on the inner wall of the furnace. This layer, as on the bottom of the furnace, forms a protective coating or lining protecting the walls against the molten rare earth metal or rare earth alloys. The material for the electrodes is determined by the product being manufactured. For the production of pure rare earth metals, molybdenum or tungsten electrodes are preferably used. In addition, graphite electrodes may be used in cases where higher carbon values are permitted in the metal. Electrodes made of tantalum may be used in some cases, as well as water-cooled copper electrodes. Care must be taken to insure that such electrodes are not dissolved by the rare earth metals or that the melt is contaminated by some other erosion of the electrodes. For the manufacture of rare earth-containing alloys which include one or several metals from the iron group in the periodic system and possibly one or several other elements, tungsten or graphite electrodes are mainly used. Additionally, electrodes made of the metals from such iron group may be used. The process according to the present invention permits the use of wide temperature ranges for the melt, as well as the utilization of a wide range of raw materials reduction agents and other additives.

Also, a wide range of rare earth metals and rare earth alloys can be produced. However, the raw materials used to produce individual rare earth metals and alloys preferably should be halides of the rare earths. When using the chlorides of individual rare earths, the temperature of the melt should not exceed 1300° C., as considerable evaporation losses may occur even at that temperature. If higher melting temperatures are necessitated because of the melting point of the rare earth metal or rare earth alloy, it has been found to be beneficial to use the corresponding rare earth fluorides. These limits, however, are considerably in excess of those permitted in fusion electrolysis. In some cases, a water content of up to 2% and an oxychloride content of up to 20% by weight are acceptable. In order to reduce the melting point of the salt slag, particularly when using the rare earth fluorides and calcium as the reducing agent, alkali halides and alkaline earth halides, preferably NaCl, $CaC_{12}$ and LiF may be added in suitable amounts.

In connection with the reduction, particularly of rare earth fluorides, it has been found that at least part of the rare earth halides can be replaced by a corresponding oxide, which usually is less expensive. The amount of oxide replacement is exclusively dependent upon the solubility of oxide in the halide melt at the reduction temperature. Preferably, granular calcium metal is successfully used as the reducing agent. Magnesium and mixtures of calcium and magnesium have also been successfully used. The amount of reducing agent used, which may be in excess of the stoichiometric requirement, depends mainly on the alkaline earth metal contents permitted in the finished rare earth metals and alloys, and also on the required rare earth yield.

If the highest possible yield of rare earth is deemed desirable because of economic considerations, one must naturally expect higher alkaline earth contents in the metals and alloys. Surprisingly, it was found that with the process taught herein, the ratio of rare earth yield to alkaline earth content in the metals and alloys is significantly more favorable than with conventional processes. For example, with a rare earth yield of 95%, the calcium content in the rare earth metal was lower by about the factor 10 than in the conventional calciothermal reduction shell. In many cases, therefore, the rare earth metals and alloys produced according to the invention did not need to be refined in order to remove the excessive alkaline earth content.

The alloying components from the ferrous metal group and the other alloying elements required for the production of rare earth-containing alloys can be utilized in any form adapted to the concept of the plant. However, their introduction in the metallic, finely particulate form was found to be advantageous. For example, iron was used in the form of finely particulate iron scrap or sponge iron, and boron in the form of ferroboron. Another advantage of the process of the invention is that the furnace construction permits a practically continuous operation. After a bath of metal melt has been tapped, the salt slag formed is drained into a separate receiver. However, a sufficient amount of melt is left in the furnace for the next charge. Furthermore, if the contents of the furnace are tapped completely, the part of the slag which is still liquid can be returned by lifting the roof of the furnace.

The process of the invention is explained in greater detail in the following specific examples.

COMPARATIVE EXAMPLE USING A PRIOR ART METHOD

A part of a mixture consisting of 50 kg dehydrated neodymium chloride (0.8% residual water; 14% oxychloride) and 13.3 kg granulated calcium metal was placed in a vessel made of molybdenum. The vessel was inductively heated from the outside via an iron crucible. The induction coil, iron crucible and molybdenum vessel were installed in a chamber. The chamber was evacuated which permitted carrying out the reaction under argon in the normal, under- and overpressure ranges. To start the reduction, the charge was heated to about 1200° C. After melting the charge and the completion of the reaction, the remainder of the mixture was added over a period of about 30 minutes via a gate system. To complete the reduction, the temperature was maintained for another 30 minutes. Subsequently, the metal and salt slag were poured separately for the most part into cast iron receivers. The metal so obtained was treated with water to separate it from the $CaC_{12}$-slag. The yield cam to 26.1 kg neodymium and 36.5 kg salt slag with 7.8% Nd-content. The total charge time, excluding cooling, lasted 3 hours and 45 minutes (see Table 1).

EXAMPLE 1

In the electric arc furnace shown in FIG. 1, 15 kg of a salt mixture consisting of about 70% by weight $CaC_{12}$ and about 30% by weight $CaF_2$ was premelded after igniting the arc via a short-circuiting bridge. The furnace voltage came to 90 volts and the current to between 800 and 1000 amperes. As the salt mixture was melting, the air in the furnace interior was expelled by blowing in argon. After the melt had reached a temperature of about 1100° C., the reaction mixture was added via a toothed-gear gate. The reaction mixture consisted of 50 kg dehydrated $NdC_{13}$(0.8% water; 14% oxychloride) and 13.0 kg granulated calcium metal. As soon as a light metal mist had formed in the salt melt, the furnace voltage on the tungsten electrodes immersed in the melt was reduced to 50 volts, whereas the current was increased to about 2500 amperes. The strong electromagnetic forces so produced effect a pronounced motion of the melt, by which the added materials were quickly drawn into the melt. In this way, it is possible to melt the entire reaction mixture within 35 minutes. About 5 minutes after the feed was completed, the conductivity of the salt slag decreased due to the separation of the metal mist, whereupon the metal and slag were tapped, separately for the most part, into cast iron receivers. The total duration of this furnace operation came to 1 hour and 25 minutes. The resulting neodymium metal was treated with water to remove the salt slag. 27.8 kg neodymium and 49.3 kg salt slag with 1.4% by weight Nd was obtained (see Table 1).

EXAMPLE 2

Following the procedure described in Example 1, 15 kg of salt melt consisting of 50% by weight $CaC_{12}$ and 50% by weight $CaF_2$ was premelted. At a temperature of about 1100° C. (the same as in Example 1), a mixture consisting of 40 kg neodymium fluoride, 13 kg granulated calcium metal and 23 kg anhydrous $CaC_{12}$ was added. After a melting time of 55 minutes and an additional dwelling time of 5 minutes, 27.3 kg neodymium metal and 62.5 kg salt slag with 2.4% by weight neodymium content was recovered. The total charge time came to 1 hour and 45 minutes (see Table 1).

EXAMPLE 3

15 kg anhydrous $CaC_{12}$ was premelted using the procedure specified in Example 1. After reaching a temperature of 950° to 1000° C., and after highly agitating the salt melt by electromagnetic forces, a mixture consisting of 50 kg anhydrous lanthanum chloride (0.5% residual water; 7% oxychloride) and 13.3 kg granulated calcium metal was added (see the detailed description in Example 1). The melting time was 32 minutes. After a dwelling time of 5 minutes, the metal and slag was tapped separately in to receivers. 27.8 kg lanthanum metal and 50.3 kg salt slag with 1.4% lanthanum content was obtained (see Table 1).

EXAMPLE 4

Following the procedure described in Example 1, 15 kg of anhydrous $CaC_{12}$ was premelted. At a temperature of 900° C., a mixture composed of 50 kg anhydrous cerium chloride (0.8% residual water; 8% oxychloride), 9.3 kg granulated calcium metal and 2.4 kg magnesium grit was added to the premelt. After a melting time of 35 minutes and a dwelling time of another 5 minutes, 26.8 kg cerium metal and 49.3 kg salt slag with 3.3% cerium content was poured off (see Table 1).

TABLE 1

Rare Earth Yields and Compositions of the Rare Earth Metals obtained in Examples 1 to 4.

| Example No. | Rare Earth Metal (kg) | Composition % Ca | % Mg | % W | Rare Earth Yield (%) |
|---|---|---|---|---|---|
| Comp. Example | 26.1 | 1.3 | 0.2 | — | 90.2 |
| 1 | 27.8 | .3 | .7 | .05 | 97.2 |
| 2 | 27.3 | .28 | .07 | .06 | 95.2 |
| 3 | 27.8 | .25 | .06 | .03 | 98.4 |
| 4 | 26.8 | .20 | .30 | .03 | 94.7 |

EXAMPLE 5

In the arc furnace shown in FIG. 1, 15 kg anhydrous $CaC_{12}$ was premelted as described in Example 1. In this example, arc electrodes were used which were made of unalloyed, low-carbon steel. With the temperature of the salt melt at 850° to 900° C., a mixture consisting of 50 kg anhydrous neodymium chloride (0.8% residual water; 14% oxychloride), 13 kg granulated calcium metal and 2.3 kg sponge iron was added. During this addition, the melt was undergoing the strong agitation caused by the electromagnetic forces as described in Example 1. The melting time was 33 minutes. After an additional heating time of 5 minutes and a total melting time of 1 hour and 22 minutes, the alloy and salt slag content of the furnace was poured, separately for the most part, into receivers. 32.5 kg alloy and 49.8 kg salt slag with 1.3% neodymium content was obtained (see Table 2).

EXAMPLE 6

Following the procedure of Example 1, 15 kg anhydrous $CaC_{12}$ was premelted. At a melt temperature of 1000° to 1050° C., a mixture consisting of 40 kg dysprosium fluoride, 12 kg granulated calcium metal, 3.7 kg sponge iron and 7 kg anhydrous $CaC_{12}$ was added. After an addition time of 35 minutes and dwelling time of 5 minutes a yield of 31.3 kg alloy and 54.8 kg salt slag with 4.5% dysprosium content was obtained. The electrodes of the arc furnace of the Example were made of tungsten (see Table 2).

TABLE 2

Rare Earth Yields and Compositions of the Rare Earth Alloys obtained in Examples 5 and 6.

| Example No. | Rare Earth Alloy (kg) | Composition % Ca | % Mg | % W | % Fe | Rare Earth Yield (%) |
|---|---|---|---|---|---|---|
| 5 | 32.5 | .25 | .05 | — | 13.5 | 97.4 |
| 6 | 31.3 | .45 | .07 | .30 | 11.9 | 92.4 |

EXAMPLE 7

In an electric arc furnace equipped with water cooled copper electrodes and following the procedure described in Example 1, 15 kg of a salt mixture consisting of 60% by weight $CaF_2$ and 40% by weight anhydrous $CaC_{12}$ was premelted. At a temperature of the salt melt of between 1300° and 1350° C., the arc furnace was charged with a mixture composed of 30 kg neodymium fluoride, 9.5 kg granulated calcium metal, 3.9 kg ferroboron (19.6% B), 10 kg sponge iron, 25.0 kg finely particulate pure iron scrap and 11.0 kg anhydrous $CaC_{12}$. The latter mixture was added over a period of 44 minutes (addition time). After another heating or dwelling period of about 5 minutes, the alloy, which was free from salt slag for the most part, was poured into an ingot mold and the slag drained into a separate receiver. 58.6 kg Nd-Fe-B alloy and 44.2 kg salt slag with 4.3% neodymium content was obtained. The alloy had the following composition:

33.5% Rare Earth
1.3% B
0.07% Al
0.08% Si
0.05% Ca
0.05% Mg

The rare earth yield of 91.3% was intentionally slightly lower in order to limit the calcium content of the alloy.

The results of Examples 1 to 7 clearly show that the process of the present invention produces rare earth metals and alloys very rapidly with high rare earth yields and economy. This is the result of the very rapid and intimate blending of the reaction partners that is achieved by the strong agitation effect produced by the electromagnetic forces.

While only several embodiments and examples of the present invention have been shown and described, it is obvious that many changes and modifications may be made thereunto, without departing from the spirit and scope of the invention.

What is claimed is:

1. A two phase process for the production of rare earth metals and alloys thereof, in an electric arc furnace, comprising the steps of:

introducing into said furnace, in a first phase, salts selected from the group consisting of alkali earth metal salts, alkaline earth metal salts, and a combination thereof;

melting said salts with said electric arc;

replacing the air within said furnace with a gas inert to said rare earth metals alkaline earth metals and compounds thereof;

adding and melting in said furnace in a second phase members selected from the group consisting of alkaline earth metals, rare earth halides, rare earth metal oxides, and a combination thereof, and additional alloying elements after said salt melt has reached a predetermined temperature;

reducing said melt in said furnace with an alkaline earth metal;

agitating the melt with electromagnetic forces caused by a preselected current-to-voltage ratio of said electric arc for a predetermined time; and tapping said rare earth metals and alloys thereof into a receiver.

2. A process according to claim 1, wherein the alloying elements are in the metallic form, as an oxide or in the form of their salts.

3. A process according to claim 1, wherein said earth metal salts are selected form a group consisting of LeF, $CaF_2$, $CaCl_2$ and a combination thereof.

4. A process according to claim 1, wherein said at least one alkaline earth metal is selected from the group consisting of Ca, Mg, and a combination thereof.

5. A process according to claim 1, wherein said alloying elements are selected from a group consisting of Fe, Co, Ni, and a combination thereof, in an amount of from 5% to 80% by weight.

6. A process according to claim 1, wherein said alloying elements are selected from the 3a-group in an amount of from 0.02% to 15/% by weight.

7. A process according to claim 1, wherein said alloying elements are selected from the group consisting of Fe, Co, Ni, and a combination thereof, in an amount of 50% to 80% by weight, and at least one element from the 3a-group in an amount of from 0.02% to 5% by weight.

8. A process according to claim 7, wherein said 3a-group consists of B and Al, and a combination thereof.

9. A process according to claim 1, wherein said rare earth halides are selected from the group consisting of fluorides, chlorides, and a combination thereof.

10. A process according to claim 1, wherein the electrodes for the production of rare earth alloys are inert to the rare earth alloys.

11. A process according to claim 1, wherein the electrodes for the production of rare earth alloys are made from ferrous metals.

12. A process according to claim 1, wherein said electrodes are substantially inert to rare earth metals.

13. A process according to claim 12, wherein said electrodes are made of a member selected from the group consisting of carbon, tungsten, copper, molybdenum, tantalum, and a combination thereof.

14. A process set forth in claim 1, wherein said additional alloying elements include members selected from the group consisting of ferrous metals, alkali earth metal salts, alkaline earth metal salts, and a combination thereof.

15. A process according to claim 1, wherein said arc furnace has a roof construction and the air is replaced with the inert gas between the roof construction and the melt in the furnace, generating said electromagnetic forces by electrodes extending through the roof construction into the melt, and continuously feeding the salts in the first phase and the members in the second phase through the roof construction into the furnace adjacent the electrodes.

* * * * *